US006719286B1

(12) United States Patent
Ohyama et al.

(10) Patent No.: US 6,719,286 B1
(45) Date of Patent: Apr. 13, 2004

(54) SHEET CONVEYING APPARATUS AND IMAGE FORMING APPARATUS HAVING THE SAME

(75) Inventors: Kazuo Ohyama, Kawasaki (JP); Makoto Kashimura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 74 days.

(21) Appl. No.: 09/692,161

(22) Filed: Oct. 20, 2000

(30) Foreign Application Priority Data

Oct. 25, 1999 (JP) ..... 11-303042

(51) Int. Cl.[7] ..... B65H 3/06

(52) U.S. Cl. ..... 271/119; 271/272; 271/228; 271/122; 492/27

(58) Field of Search ..... 271/272, 122, 271/228, 119; 492/27

(56) References Cited

U.S. PATENT DOCUMENTS

| | | | | |
|---|---|---|---|---|
| 2,952,201 A | | 9/1960 | Gibson | |
| 3,788,638 A | * | 1/1974 | Lehmann | |
| 4,188,025 A | * | 2/1980 | Gusfafson et al. | |
| 4,699,366 A | | 10/1987 | Kashimura et al. | 271/4 |
| 4,717,938 A | | 1/1988 | Tanjo | 355/3 SH |
| 4,772,007 A | | 9/1988 | Kashimura | 271/22 |
| 5,404,154 A | | 4/1995 | Tomari et al. | 347/153 |
| 5,540,427 A | | 7/1996 | Nitta et al. | 271/274 |
| 5,725,319 A | | 3/1998 | Saito et al. | 400/629 |
| 5,734,404 A | * | 3/1998 | Komuro et al. | |
| 5,961,234 A | | 10/1999 | Uchikata | 400/636 |
| 6,032,945 A | * | 3/2000 | Miura | |
| 6,193,232 B1 | * | 2/2001 | Regimbal et al. | |

FOREIGN PATENT DOCUMENTS

| | | | | |
|---|---|---|---|---|
| EP | 0 285 659 | | 10/1988 | |
| JP | 60-036243 | | 2/1985 | |
| JP | 60-061443 | | 4/1985 | |
| JP | 02028449 A | * | 1/1990 | B65H/09/06 |
| JP | 04-101959 | | 4/1992 | |
| JP | 07-157165 | | 6/1995 | |
| JP | 07-315616 | | 12/1995 | |
| JP | 09-202024 A | * | 8/1997 | B29D/31/00 |
| JP | 11-13744 | | 1/1999 | |
| JP | 11-013744 | | 1/1999 | |

* cited by examiner

*Primary Examiner*—Christopher P. Ellis
*Assistant Examiner*—Mark A. Deuble
(74) *Attorney, Agent, or Firm*—Fitzpatrick, Cella, Harper & Scinto

(57) ABSTRACT

To provide a sheet conveying apparatus of low cost and high durability and also to provide an image forming apparatus having the same. A sheet S1 is pinched and conveyed by a metal driving roller having roughness provide on its surface and a pinch roller coming in pressure contact with the driving roller and thereby driven to rotate. And the pinch roller is formed of synthetic resin, so that the pinch roller can be manufactured less costly and the durability of the same can be increased.

19 Claims, 4 Drawing Sheets

SHEET CONVEYING APPARATUS AND IMAGE FORMING APPARATUS HAVING THE SAME

BACKGROUND OF THE INVENTION

1. Field of the Invention

The present invention relates to a sheet conveying apparatus and an image forming apparatus having the same, in particular, to a material and shape of a pinch roller which is provided in the sheet conveying apparatus and constitutes a component of a pair of conveying rollers for pinching and conveying a sheet.

2. Related Background Art

In the past, an image forming apparatus such as printer, copying machine and facsimile has been provided with a sheet conveying apparatus for conveying a sheet to an image forming portion, and as the sheet conveying apparatus, known is the type which is provided with a pair of conveying rollers comprising a rubber driving roller which comes in contact with a back surface of the sheet and a pinch roller which presses the sheet on the rubber driving roller.

In regard to the rubber roller, the limits of deflection and outside diameter accuracy are low and outside-diameter changes with temperature change are large. In order to cope with this situation, as the configuration for obtaining much higher conveying accuracy, there is provided a sheet conveying apparatus configured by using, as the driving roller, a metal roller having roughness provided on the surface thereof and, as the driven pinch roller, a rubber roller having a fluorine coating applied on the surface thereof as disclosed in, for example, Japanese Patent Application Laid-Open No. 11-013744.

At this point, with the roughness provided on the metal roller surface, the metal roller can convey a sheet because the roughness bites into the back surface of the sheet. And the fluorine coating applied on the rubber roller surface not only enables the prevention of the plasticizer contained in the rubber from being eluted and deposited on the sheet surface, but also enables the decrease in $\mu$ value (frictional resistance value) of the rubber. Thus the leading end of the sheet is allowed to enter the nip portion between the conveying roller and the pinch roller without failure.

At the time of using a rubber roller, as the pinch roller, which comes in pressure contact with a conveying roller rotating in the opposite direction to the conveying direction of a sheet so as to correct skew feed of the sheet, the leading end of the sheet is allowed to be prevented from folding when it strikes the pinch roller during the skew feed correcting operation by decreasing $\mu$ value of the rubber roller surface in such a manner as to apply a fluorine coating on the surface of the rubber roller.

The sheet conveying apparatuses of the conventional art which are provided with the pinch roller as described above, however, give rise to problems that applying a fluorine coating on the rubber roller surface is very costly and that the fluorine coating wears easily, accordingly, the durability of the pinch roller is low.

Next, the state in which the fluorine coating wears will be briefly described with reference to FIG. 7. In FIG. 7, reference numeral 8 denotes a conveying roller having a roughness 8*a* provided on its surface and numeral 16 a pinch roller driven to rotate by coming in pressure contact with the conveying roller 8, and the pinch roller 16 includes a rubber roller 16*a* and a fluorine coating layer 16*b* formed on the rubber roller 16*a*.

Furthermore, the conveying roller 8 and the pinch roller 16 are designed to rotate in the opposite direction to the conveying direction of a sheet, as indicated by an arrow B, at the time of starting the sheet feeding operation. And correction of skew feeding is performed in such a manner as to form a loop of a sheet S1 by allowing the leading end of the sheet S1 conveyed by a sheet feeding mechanism not shown in the figure to strike the nip portion between the conveying roller 8 and the pinch roller 16 both of which are rotating.

During this correction of skew feeding, since the pinch roller 16 rotates against the leading edge portion of the sheet S1, the fluorine coating layer 16*b* applied on the surface of the pinch roller 16 is abraded by the leading edge portion of the sheet S1 and wears gradually.

Although the state in which the fluorine coating wears has been described in terms of the correction of skew feed in reverse rotation in which the sheet S1 is allowed to strike the conveying roller 8 and the pinch roller 16 both rotating in the reverse direction, the fluorine coating layer 16*b* also wears during the correction of skew feed in stopping rotation in which the sheet S1 is allowed to strike the conveying roller 8 and the pinch roller 16 both in a stopped state, though the degree of wearing differs from each other.

When the fluorine coating layer 16*b* becomes worn as described above, the rubber roller 16*a* becomes exposed with the increase in the number of sheets passing through the apparatus, which causes deposition of the plasticizer on the sheet S1 and folding of the leading end of the same.

SUMMARY OF THE INVENTION

The present invention has been achieved in light of the situation as described above; accordingly, the object of the present invention is to provide a sheet conveying apparatus of low cost and high durability and an image forming apparatus having the same.

The present invention provides a sheet conveying apparatus including a pair of conveying rollers for pinching and conveying a sheet by means of a metal driving roller having roughness provided on a surface thereof and a pinch roller coming in pressure contact with and being driven by the metal driving roller to be rotated, in which the pinch roller is formed of a synthetic resin or a resin.

In the sheet conveying apparatus, the pinch roller is formed in such a manner that the outside diameter of the opposed end portions of the pinch roller is smaller than that of the other portion of the pinch roller.

In the sheet conveying apparatus, the pinch roller is formed in such a manner that the outside diameter of the opposed end portions of the pinch roller is smaller than that of the substantial center portion of the pinch roller and that the opposed end portions and the center portion have a smoothly connected shape.

In the sheet conveying apparatus, the outside diameter of the opposed end portions of the pinch roller is smaller than that of the substantial center portion by 10 $\mu$m or more.

In the sheet conveying apparatus, the opposed end portions of the pinch roller have a round-shape.

In the sheet conveying apparatus, the pinch roller is formed of the material of which main raw material is polyacetal.

In the sheet conveying apparatus, the pinch roller is formed with a die, the die is parted in the longitudinal direction so that the parting line will not appear on the circumference of the pinch roller, the inside diameter of the die part for forming the end portion near the core side of the pinch roller is smaller than that of the portion for forming the substantial center portion of the pinch roller, and the inside diameter of the die is set in such a manner that galling is not caused between the pinch roller and the die during the mold releasing in expectation of some percentage for shrinkage of the substantial center portion of the pinch roller during the resin filling—cooling—releasing processes.

In the sheet conveying apparatus, the roughness is provided on the surface of the driving roller by coating the surface of a metal roller with ceramic powder or alumina powder.

In the sheet conveying apparatus, the roughness is provided on the surface of the driving roller by subjecting the surface of a metal roller to blast finishing.

In the sheet conveying apparatus, the roughness is provided on the surface of the driving roller by subjecting the surface of a metal roller to knurling.

Further, the present invention is an image forming apparatus including an image forming portion and a sheet conveying apparatus for conveying a sheet to the image forming portion, and as the sheet conveying apparatus, any one of the apparatus described above is used.

And, the sheet is pinched and conveyed by a metal driving roller having roughness provided on its surface and a pinch roller coming in pressure contact with the driving roller and thereby driven to rotate. The pinch roller is formed of a synthetic resin or a resin, thereby the pinch roller can be manufactured less costly and the endurance of the same can be increased.

DESCRIPTION OF THE PREFERRED EMBODIMENTS

Now, the embodiments of the present invention will be described in detail with reference to the attached drawings.

Figure 1:
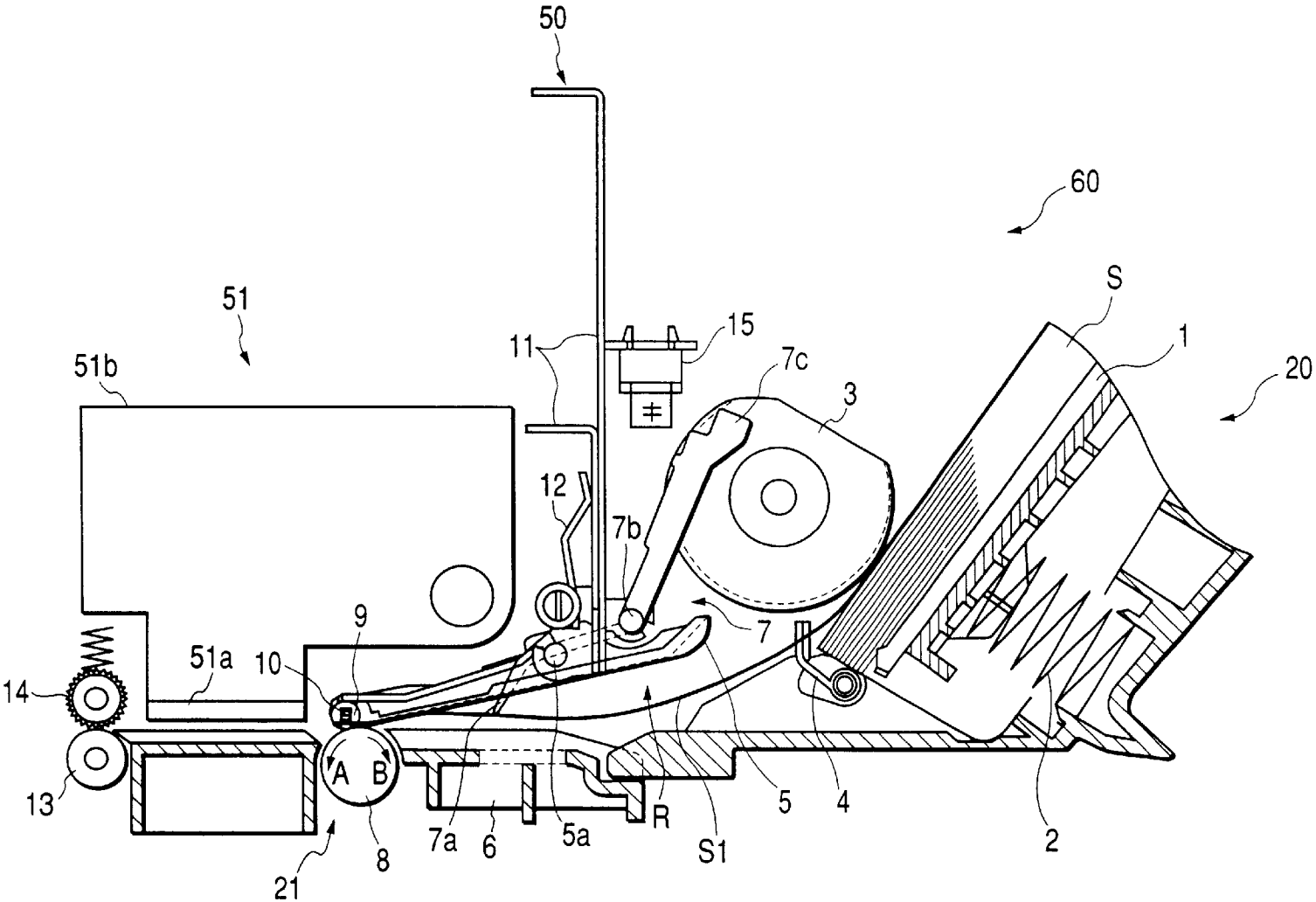
FIG. 1 is a view illustrating the configuration of an image forming apparatus having a sheet conveying apparatus according to one embodiment of the present invention.

FIG. 1 is a view illustrating the configuration of an image forming apparatus having a sheet conveying apparatus in accordance with one embodiment of the present invention.

In FIG. 1, reference numeral 50 denotes an image forming apparatus having an image forming portion 51, numeral 60 a sheet conveying apparatus which includes a sheet containing portion 20 for containing sheets S, a feed roller 3 for feeding a sheet S1 contained in the sheet containing portion 20, a separation claw 4 provided downstream of the sheet containing portion 20 in a sheet feeding direction and for separating the sheets S fed by the feed roller 3, and a conveying portion 21 for conveying the sheet S1 separated by the separation claw 4 to the image forming portion 51.

The sheet containing portion 20 is provided with a sheet feed pressure plate 1 for stacking sheets S thereon and pivotable on a pivot shaft not shown in the figures. The sheet feed pressure plate 1 is urged against the feed roller 3 by a pressure plate spring 2.

The feed roller 3 is in the form of a semicircular with its peripheral surface partially cut away and, when being in a stand-by state after feeding a sheet, it is stopped with its chord portion (the cut-away portion) being opposite to the sheets S by a lock mechanism not shown in the figures. In this stand-by state, the sheet feed pressure plate 1 is also stopped in state where it is pressed down away from the feed roller 3 by a cam mechanism not shown in the figures, which allows the feed roller 3 and the sheets S to be kept out of contact with each other.

The conveying portion 21 includes a conveying guide 6, a pinch roller holder 5 which forms a sheet conveying path R together with the conveying guide 6, a conveying roller (or driving roller) 8 rotatable in the directions indicated by the arrows A and B by a driving mechanism not shown in the figures, and a pinch roller 9 rotatably held at the distal end portion of the pinch roller holder 5 via a pinch roller shaft 10.

The pinch roller holder 5 is pivotably supported by a chassis 11 of the image forming apparatus 50 via a pivot shaft 5*a* and urged in such a direction as to press the pinch roller 9 against the conveying roller 8 at a predetermined pressure by a torsion coil spring 12 hung between the chassis 11 and the pinch roller holder 5. During a predetermined period of time after starting the feeding operation, the conveying roller 8 and the pinch roller 9 are rotated in the opposite direction to the conveying direction of a sheet, that is, in the direction indicated by the arrow B or are in the stopped state so as to correct skew feed of the sheet.

The image forming portion 51 includes a recording head 51*a* and a carriage 51*b* for holding the recording head 51*a* and moving in the direction perpendicular to the sheet conveying direction. After correcting the skew feed as described later, printing is performed by the recording head 51*a* on the sheet S1 conveyed to a print starting position by the conveying roller 8 rotating in the direction indicated by the arrow A while moving the carriage 51*b*.

In FIG. 1, reference numeral 7 denotes a pass detecting lever which is pivotably supported by the chassis 11 via a pivot shaft 7*b* and one end portion 7*a* of the pass detecting lever 7 is projected out in the sheet conveying path and numeral 15 a detecting sensor for detecting the pivotal movement of this pass detecting lever 7.

The pass detecting lever 7 is allowed to pivot on the pivot shaft 7*b* in the clockwise direction, as shown in FIG. 1, when the sheet S1 presses the one end portion 7*a* during passing through the sheet conveying path R. The other end portion 7*c* also moves when the pass detecting lever 7 is pivotally moved, and the detecting sensor 15 detects this movement and outputs a detection signal to control means, not shown in the figures, for controlling the driving mechanism.

In FIG. 1, reference numeral 13 denotes a discharge roller and numeral 14 a spur in pressure contact with the discharge roller 13 both of which serve to discharge the printed sheet S1 into a discharge tray not shown in the figures.

Now, the sheet conveying operation of the image forming apparatus (the sheet conveying apparatus) configured in the above manner will be described below.

When starting the sheet feeding operation, the feed roller 3 having been out of contact with sheets S starts to rotate and the sheet feed pressure plate 1 having been pressed down away from the feed roller 3 is pushed up. This allows the arc portion of the feed roller 3 to come in contact with the topmost sheet S1, which means that the sheet S1 starts to be conveyed. At this time, the stacked sheets other than the topmost one tend to move; however, due to the action of separation claw 4, the topmost sheet alone is conveyed.

After this, the separated sheet S1 is guided to the conveying path R formed by the pinch roller holder and the conveying guide 6 and presses the one end portion 7*a* of the pass detecting lever 7 projected out in the conveying path. At this time, when one end portion 7*a* is pressed, the pass detecting lever 7 starts to pivot, and the detecting sensor 15 detects this pivotal movement and outputs a detection signal to the control means.

The control means controls the driving mechanism based on the detection signal so that the feed roller 3 will rotate in such a manner as to allow the distal end portion of the sheet S1 to move as far as the nip portion, which has been formed by the conveying roller 8 and the pinch roller 9, plus 2 to 3 mm. Conveying the sheet S1 an extra 2 to 3 mm allows the entire width of the leading end of the sheet S1 having been fed in the skew feed state to strike the nip position without failure.

Meanwhile, because the conveying roller 8 and the pinch roller 9 are rotating in the opposite direction to the conveying direction of the sheet S1, that is, in the direction indicated by the arrow B or are in the stopped state, the sheet S1 is warped in accordance with an extra conveyed amount after the sheet S1 reaches the nip portion as shown in FIG. 1, and skew feed is corrected. The feed roller 3 at this point is in state where its arc portion is in contact with the sheet S1.

After correcting the skew feed, the sheet S1 is conveyed to the print starting position by rotating the conveying roller 8 in the sheet conveying direction, that is, in the direction indicated by the arrow A and rotating the feed roller 3 as well. When the sheet S1 is conveyed to the print starting position in the above manner, the feed roller 3 and the sheet feed pressure plate 1 are returned to their stand-by position.

Then printing is performed by the recording head 51*a* on the sheet S1 having been conveyed to the print starting position while moving the carriage 51*b*, and after this, the printed sheet S1 is discharged into the discharge tray by the discharge roller 13 and the spur 14 urged against toward the discharge roller 13.

Figure 2:
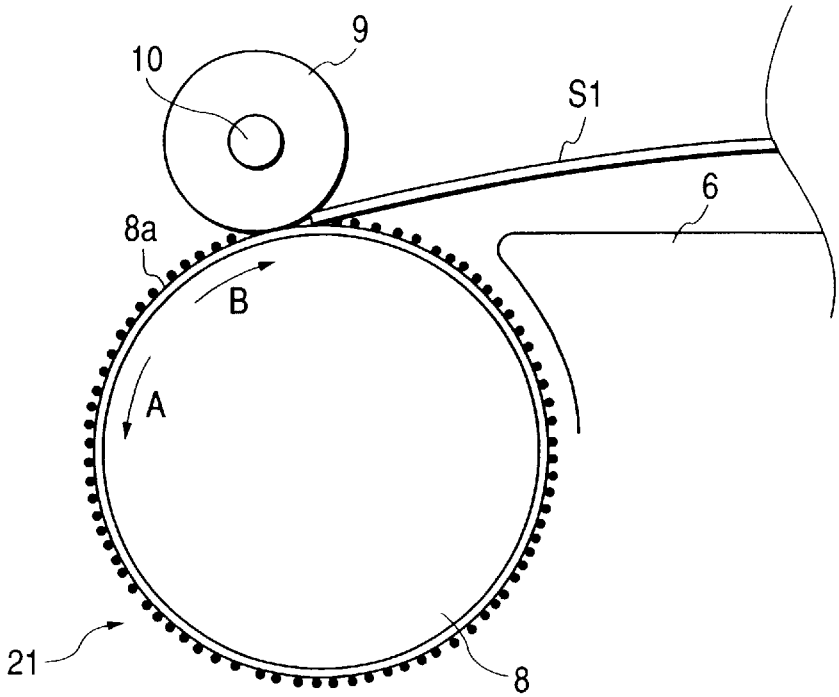
FIG. 2 is an enlarged view of the sheet conveying portion of the sheet conveying apparatus of FIG. 1.

On the other hand, referring now to FIG. 2, there is shown an enlarged view of the conveying portion 21. As shown in FIG. 2, the conveying roller 8 has ceramic powder 8*a* coated on its surface, so as to have roughness thereon. Due to the roughness (the ceramic powder 8*a*), the conveying roller 8 is allowed to hold fast to the back side of the sheet S1 while letting the roughness bite an the back side of the sheet S1 and generating a strong conveying force.

Figure 7:
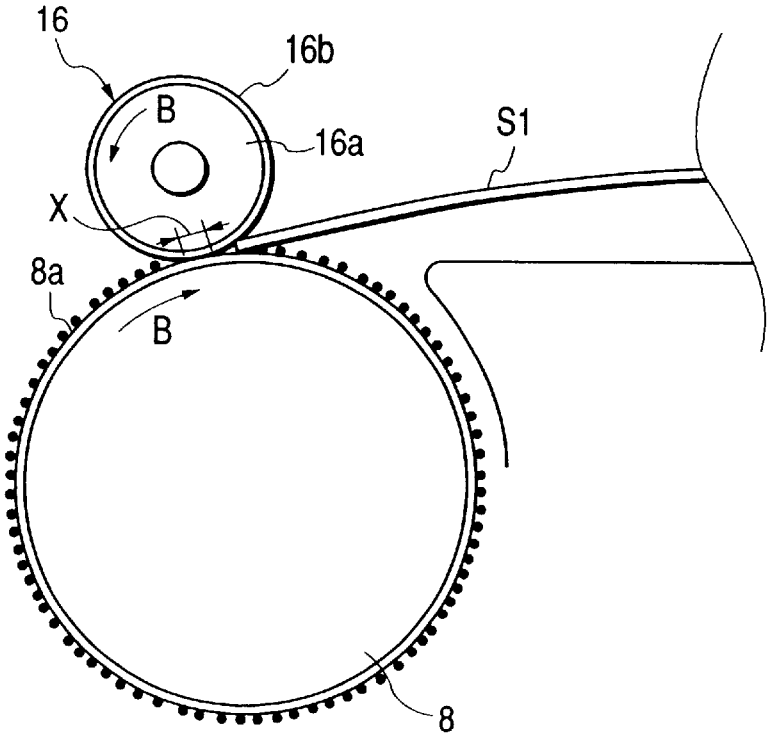
FIG. 7 is a view illustrating a skew feed correcting operation in a sheet conveying apparatus according to the conventional art.

In the conventional technique, the conveying force has been obtained by providing a nip width (X of FIG. 7) in such a manner as to allow any one of the conveying roller 8 and the pinch roller 9 to be a rigid body and allow the remaining one to be an elastic body.

However, it has been found that the use of the metal roller having roughness provided on its surface makes it possible to obtain almost the same conveying force, even in a case of using synthetic resin which is a rigid body as the material of the pinch roller in comparison with a case of using rubber which is an elastic body as the material of the pinch roller, since the roughness of the surface allows the conveying roller 8 to hold fast to the back side of the sheet, as described above.

In fact, according to experiments, when the metal roller having ceramic powder coated on its surface was used as a conveying roller, and even in a case of using a pinch roller formed of synthetic resin of which chief raw material is polyacetal, the conveying power was lowered only by about 5% compared with the case of using a pinch roller formed of 60 hardness rubber having a fluorine coating 20 $\mu$m thick applied on its surface, though it depends on the kind of sheet used.

Accordingly, when the same conveying force must be obtained, the roller formed of synthetic resin can be used as a pinch roller instead of that of rubber as an elastic body only by slightly increasing the load of the torsion coil spring 12 (refer to FIG. 1).

At the time of conducting a sheet passing endurance test with a pinch roller formed of rubber having a fluorine coating applied on its surface, the fluorine coating layer started to peel and the rubber surface was exposed after about 30 thousands of sheets passed through it. As a result, in the skew feed correcting operation, the leading end of the sheet tended to be folded and did not fully strike the nip portion due to the high $\mu$ value of the rubber; accordingly the correction of skew feed could not be fully done. On the other hand, at the time of conducting the same sheet passing endurance test with a pinch roller formed of synthetic resin, the problems as described above did not arise even after 60 thousands of sheets passed through the pinch roller.

Thus, in this embodiment, the pinch roller 9 is formed of resin in order not only to reduce costs, but also to increase the durability thereof. The shape and material of the pinch roller will be described below.

First, the shape of the pinch roller will be described. The pinch roller 9 comprises a cylindrical roller body formed of resin and a hole 9*c* formed in the center of the roller body into which the shaft 10 formed of metal, resin, etc. is press fitted. "Pinch roller" used herein means mainly the roller body.

Figure 3A:
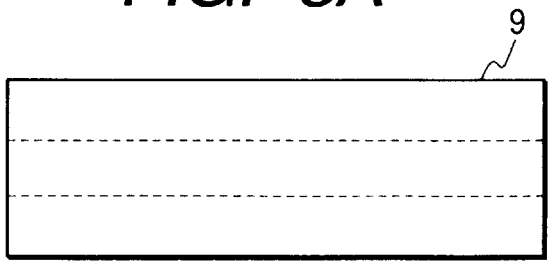
FIGS. 3A, 3B and 3C are views showing a shape of a pinch roller of the sheet conveying portion of FIGS. 1 and 2.
Figure 3B:
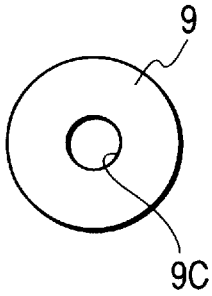
Figure 3C:
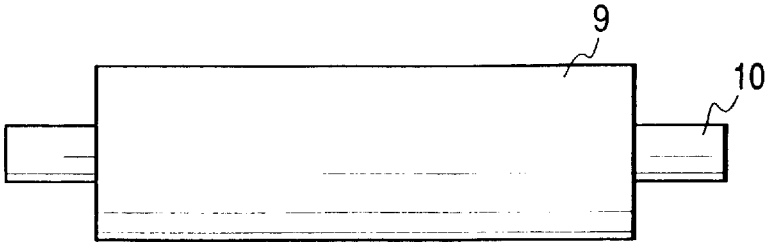

Alternatively, as shown in FIG. 3C the pinch roller (the roller body) 9 and the shaft 10 may be formed of resin as an integral unit.

With the advance in quality of the images formed by the latest image forming apparatus such as a ink jet print, there arise cases where thick paper or special paper comprising a plastic sheet and an ink receptive layer provided on the plastic sheet is used as a sheet in addition to plain paper.

Accordingly, the shape of the pinch roller needs to be decided depending on the kind of sheet to be used in the image forming apparatus. At the time of using plain paper alone, the shape may be simply cylindrical as shown in FIGS. 3A and 3B. At the time of using thick paper or special paper comprising a plastic sheet and an ink receptive layer provided on the plastic sheet, however, if the pinch roller 9 as shown in FIGS. 3A to 3C is used, both end portions (edges) of the pinch roller 9 may sometimes bite into the ink receptive layer because the conveying roller 8 is also a rigid body, though they bite only slightly, and damage the ink receptive layer.

Figure 4A:
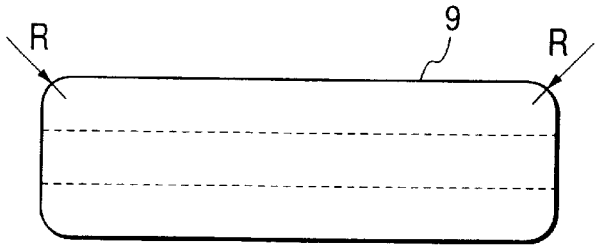
FIGS. 4A and 4B are views showing another shape of the pinch roller of the sheet conveying portion of FIGS. 1 and 2.

Therefore, at the time of using special paper, it is effective to radius each of the end portions of the pinch roller 9, as shown in FIG. 4A. The methods of providing round-shape R on each of the end portions of the pinch roller 9 include, for example, subjecting both ends of the pinch roller 9 shown in FIG. 3A to after-machining such as cutting.

Alternatively, both ends of the pinch roller 9 may be shaped not to come in contact with the sheet surface not by after-machining, but by radiusing the both ends using dies.

Figure 5:
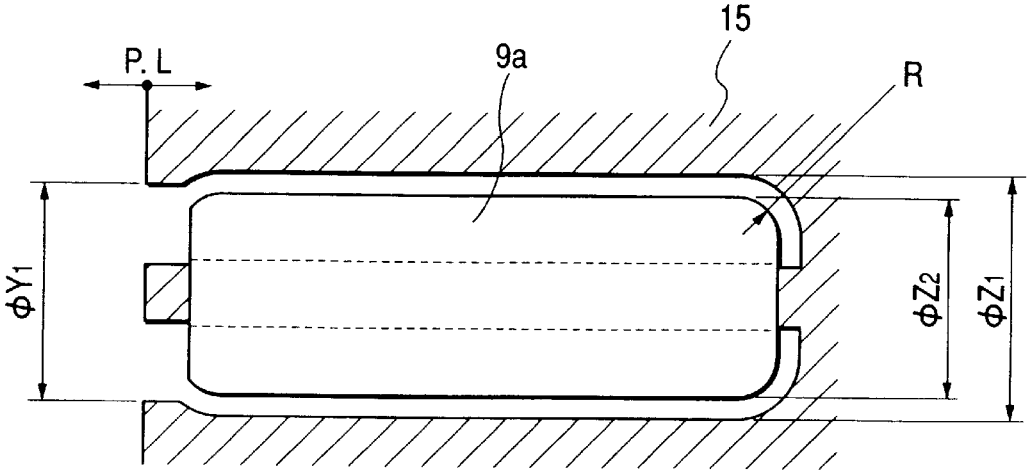
FIG. 5 is a view illustrating a method of forming the pinch roller having the another shape as shown in FIGS. 4A and 4B.

Referring to FIG. 5, there is shown a view illustrating the method of forming a pinch roller using dies. In FIG. 5, reference numeral 15 denotes a die on the cavity side and numeral 9*a* a pinch roller which has shrunk after being cooled in the die on the cavity side and a die on the core side not shown in the figures.

In this embodiment, the die used is parted in the longitudinal direction, because if the parting line (P. L) of the die is allowed to appear on the circumference of the pinch roller 9*a*, it will damage the sheets S. And, the end portions of the die 15 on the cavity side are formed to have a round-shape R.

As for the end portions of the die on the core side, if they are formed to have a normal round-shape R, the pinch roller will become undercut and will not be able to be released; accordingly, the inside diameter $\Phi Y_1$ of the die portion for forming the end portion on the core side is set to be smaller than the inside diameter $\Phi Y_1$ of the die portion for forming the substantial center portion, in addition, the inside diameter $\Phi Y_1$ is set, in expectation of some percentage for shrinkage of the substantial center portion during the resin material filling—cooling—mold releasing processes, not to cause galling between the outside diameter $\Phi Z_2$ of the pinch roller 5and the die during the die releasing ($\Phi Z_1/2-\Phi Y_1/2=$ 10 $\mu$m or larger).

The use of such a die allows the pinch roller 9*a* to be formed in such a manner that its diameter becomes smaller only near the end portions of the pinch roller 9*a*. In this embodiment, the outside diameter of both end portions of the pinch roller 9*a* is set to become smaller than that of the other portion by 10 $\mu$m. This prevents both end portions of the pinch roller 9*a* from biting into the ink receptive layer, and hence damaging the sheets.

Figure 4B:
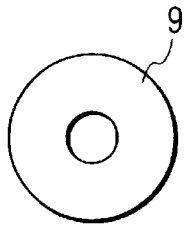
Figure 6:
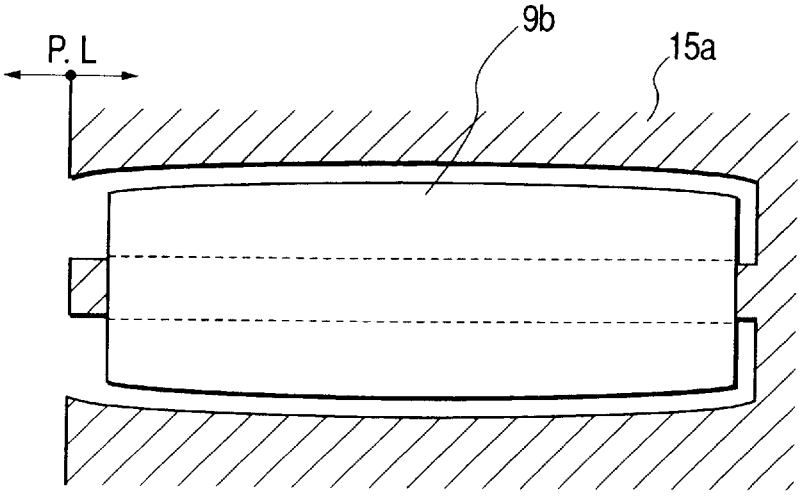
FIG. 6 is a view illustrating a method of forming the pinch roller having a barrel shape.

The shape of the pinch roller is, however, not limited to the one as shown in FIGS. 4A and 4B. The pinch roller 9*b* may be formed using a die 15*a* shown in FIG. 6 to have a barrel shape in which the outside diameter is smaller than that of the substantial center portion and both end portions and the central part are smoothly connected.

As the synthetic resin for forming such pinch rollers 9, 9*a* and 9*b*, suitably used are those of which main raw material is polyacetal, elastomer content is 0 to 50% and flexural modulus is 300 to 3500 MPa.

The higher the elastomer percentage content of the synthetic resin used is and the lower the flexural modulus of the synthetic resin is, the more the damage of the special paper etc. by both end portions of the pinch roller is reduced. In cases where the synthetic resin is used of which elastomer content is about 15% or more and flexural modulus is about 1500 Mpa or less, even if the pinch roller 9 has a simple cylindrical shape as shown in FIGS. 3A to 3C, there arises no problem of damaging the special paper.

Although the embodiment of the present invention has been described in terms of the sheet conveying apparatus employing the conveying roller 8 comprising a metal and ceramic powder 8*a* coated on the metal, the present invention is not intended to be limited to this specific example. Those apparatuses are also within the scope of the present invention which employ the conveying roller comprising a metal and alumina powder, instead of ceramic powder 8*a*, coated thereon, comprising a metal roller having been subjected to blast finishing, or comprising a metal roller having been subjected to knurling.

As described above, according to the present invention, a pinch roller, which is driven to rotate by coming in pressure contact with a metal driving roller having roughness provided on its surface, is formed of synthetic resin; accordingly, the cost of manufacturing pinch rollers can be reduced and the durability of the pinch roller can be increased. This makes it possible to provide an image forming apparatus having a sheet conveying apparatus of low cost and high durability.

What is claimed is:

1. A sheet conveying apparatus comprising a pair of conveying rollers for pinching and conveying a sheet by a driving roller having roughness provided on a surface thereof and a pinch roller coming in pressure contact with the driving roller and driven to rotate, wherein the pinch roller is formed of resin of which a main raw material is polyacetal, wherein the pinch roller is formed with a die, the die is parted in a longitudinal direction so that a parting line does not appear on a circumference of the pinch roller, an inside diameter of a portion of the die for forming the end portion near a core side of the pinch roller is smaller than an inside diameter of a portion of the die for forming the substantial center portion of the pinch roller, and is set in such a manner that scoring is not caused on the pinch roller by the die during a mold releasing operation in expectation of some percentage for shrinkage of the substantial center portion of the pinch roller during resin filling-cooling-releasing processes.

2. A sheet conveying apparatus comprising a pair of conveying rollers for pinching and conveying a sheet by a driving roller having roughness provided on a surface thereof and a pinch roller coming in pressure contact with the driving roller and driven to rotate, wherein the pinch roller is formed of resin of which a main raw material is polyacetal, wherein said pinch roller is formed with a die, the die is parted in a longitudinal direction so that a parting line does not appear on a circumference of the pinch roller, an inside diameter of a portion of the die for forming the end portion near a core side of the pinch roller is smaller than an inside diameter of the die for forming the substantial center portion of the pinch roller, and the substantial center portion of the pinch roller shrinks during resin filling—cooling—releasing processes in such a manner that the diameter of the substantial center portion of the pinch roller becomes smaller than the inside diameter of the die for forming the end portion near a core side of the pinch roller.

3. A sheet conveying apparatus according to claim 2, wherein the pinch roller comprises a cylindrical roller body having a hole into which a shaft is fitted, and the whole roller body is formed of resin.

4. A sheet conveying apparatus according to claim 3, wherein a metal shaft is fitted into the hole of the roller body.

5. A sheet conveying apparatus according to claim 2, wherein the pinch roller is formed in such a manner that an outside diameter of opposed end portions of the pinch roller is smaller than an outside diameter of other portions of the pinch roller.

6. A sheet conveying apparatus according to claim 5, wherein the outside diameter of the opposed end portions of the pinch roller is smaller than the diameter of the substantial center portion by 10 $\mu$m or more.

7. A sheet conveying apparatus according to claim 2, wherein the pinch roller is formed in such a manner that an outside diameter of opposed end portions of the pinch roller is smaller than an outside diameter of a substantial center portion of the pinch roller and that the opposed end portions and the center portion are smoothly connected.

8. A sheet conveying apparatus according to claim 2, wherein opposed end portions of the pinch roller have a round shape.

9. A sheet conveying apparatus according to claim 2, wherein the roughness is provided on the surface of the driving roller by coating a surface of a metal roller with ceramic powder or alumina powder.

10. An image forming apparatus comprising an image forming portion and a sheet conveying apparatus according to any one of claims 2–9, wherein a sheet is conveyed to the image forming portion by the sheet conveying apparatus.

11. A sheet conveying apparatus comprising a pair of conveying rollers for pinching and conveying a sheet by a driving roller having roughness provided on a surface thereof and a pinch roller coming in pressure contact with the driving roller and driven to rotate, wherein the pinch roller is formed of resin, and wherein the pinch roller is formed with a die, the die is parted in a longitudinal direction so that a parting line does not appear on a circumference of the pinch roller, an inside diameter of a portion of the die for forming the end portion near a core side of the pinch roller is smaller than an inside diameter of a portion of the die for forming the substantial center portion of the pinch roller, and is set in such a manner that scoring is not caused on the pinch roller by the die during a mold releasing operation in expectation of some percentage for shrinkage of the substantial center portion of the pinch roller during resin filling-cooling-releasing processes.

12. A sheet conveying apparatus according to claim 11, wherein the pinch roller comprises a cylindrical roller body having a hole into which a shaft is fitted, and the whole roller body is formed of resin.

13. A sheet conveying apparatus according to claim 12, wherein a metal shaft is fitted into the hole of the roller body.

14. A sheet conveying apparatus according to claim 11, wherein the pinch roller is formed in such a manner that an outside diameter of opposed end portions of the pinch roller is smaller than an outside diameter of other portions of the pinch roller.

15. A sheet conveying apparatus according to claim 14, wherein the outside diameter of the opposed end portions of the pinch roller is smaller than the diameter of the substantial center portion by 10 $\mu$m or more.

16. A sheet conveying apparatus according to claim 11, wherein the pinch roller is formed in such a manner that an outside diameter of opposed end portions of the pinch roller is smaller than an outside diameter of a substantial center portion of the pinch roller and that the opposed end portions and the center portion are smoothly connected.

17. A sheet conveying apparatus according to claim 11, wherein opposed end portions of the pinch roller have a round shape.

18. A sheet conveying apparatus according to claim 11, wherein the roughness is provided on the surface of the driving roller by coating a surface of a metal roller with ceramic powder or alumina powder.

19. An image forming apparatus comprising an image forming portion and a sheet conveying apparatus according to any one of claims 11 to 18, wherein a sheet is conveyed to the image forming portion by the sheet conveying apparatus.

* * * * *

UNITED STATES PATENT AND TRADEMARK OFFICE

CERTIFICATE OF CORRECTION

PATENT NO. : 6,719,286 B1
DATED : April 13, 2004
INVENTOR(S) : Kazuo Ohyama et al.

It is certified that error appears in the above-identified patent and that said Letters Patent is hereby corrected as shown below:

Title page,
Item [56], References Cited, U.S. PATENT DOCUMENTS, insert:
-- 5,937,260 A 8/1999 Taninaka et al. …… 399/401 --.
FOREIGN PATENT DOCUMENTS, "02028449 A" should read -- 2-028449 A --.
Item [57], ABSTRACT,
Line 4, "provide" should read -- provided --.

Column 5,
Line 55, "an" should read -- on --.

Column 6,
Line 30, "thousands of" should read -- thousand --.
Line 45, "a" should read -- an --.

Column 7,
Line 21, "$\Phi Y_1$" should read -- $\Phi Z_1$ --.
Line 27, "5and" should read -- and --.

Column 9,
Line 10, "claims 2-9," should read -- claims 1-9, --.

Signed and Sealed this

Twenty-seventh Day of July, 2004

JON W. DUDAS
*Acting Director of the United States Patent and Trademark Office*